US005123620A

United States Patent [19]

Bourne

[11] Patent Number: 5,123,620

[45] Date of Patent: Jun. 23, 1992

[54] ACCESSORY CONTAINER FOR LADDER

[76] Inventor: Richard A. Bourne, 1069 Derringer Dr., Las Vegas, Nev. 89119

[21] Appl. No.: 701,455

[22] Filed: May 15, 1991

Related U.S. Application Data

[63] Continuation-in-part of Ser. No. 584,973, Nov. 5, 1990, abandoned.

[51] Int. Cl.[5] ..... E06C 7/14

[52] U.S. Cl. ..... 248/210; 248/310

[58] Field of Search ..... 248/210, 211, 238, 309.1, 248/310, 311.2; 182/129

[56] References Cited

U.S. PATENT DOCUMENTS

| | | | |
|---|---|---|---|
| 2,102,078 | 12/1937 | Kemp | 248/210 |
| 2,911,133 | 11/1959 | Ruggieri | 182/124 |
| 3,285,557 | 11/1966 | Reda | 248/210 |
| 3,309,053 | 3/1967 | Baker | 248/210 |
| 3,375,899 | 4/1968 | George | 182/122 |
| 3,940,824 | 3/1976 | Gioia et al. | 15/257 |
| 4,480,810 | 11/1984 | Hall | 248/238 |
| 4,589,521 | 5/1986 | Finster et al. | 248/238 X |
| 4,613,042 | 9/1986 | Aeschliman | 206/419 |
| 4,703,833 | 11/1987 | Bachman | 248/238 X |
| 4,706,918 | 11/1987 | Wilson | 248/210 |
| 4,730,802 | 3/1988 | Chatham et al. | 248/238 |
| 4,815,684 | 3/1989 | Kellstadt | 248/210 |
| 4,862,994 | 9/1989 | Hughes, Sr. | 182/122 |
| 4,887,713 | 12/1989 | Tupper | 206/225 |

OTHER PUBLICATIONS

Westway Product brochure.

*Primary Examiner*—Ramon O. Ramirez

*Attorney, Agent, or Firm*—Quirk, Tratos & Roethel

[57] ABSTRACT

An accessory container is designed to be mounted over the top platform of a stepladder. The accessory container includes a forward compartment defined by a front wall, a back interior wall, a right side wall, a left side wall and a bottom wall. The forward compartment is open at the top and provides a storage area for holding tools, equipment and other work supplies that are needed by the worker when he is using the stepladder to perform construction or maintenance chores. The accessory container further includes a rearward compartment defined by the back interior wall, side wall extensions on each of the right and left side walls, a top plate and a rear overlapping lip. The rearward compartment is open at the bottom and allows the accessory container to be mounted over the top of the stepladder. The top platform of the stepladder abuts the underside of top plate of the accessory container and the rear legs of the stepladder abut the back interior wall of the accessory container. The top corner of the stepladder's top platform hooks under the rear overlapping lip of the rear compartment of the accessory container. This arrangement results in any weight that is placed in the forward compartment being transferred through the back interior wall of the accessory container to the rear legs of the stepladder. This increases the structural stability of the accessory container and holds it securely in place on the stepladder.

4 Claims, 3 Drawing Sheets

ACCESSORY CONTAINER FOR LADDER

CROSS REFERENCE TO RELATED APPLICATION

This application is a continuation-in-part of application Ser. No. 07/584,973, filed Nov. 5, 1990, entitled "Ladder Helper", now abandoned.

BACKGROUND OF THE INVENTION

This invention relates to an accessory container for a ladder, and more particularly to an accessory container for a ladder that is designed to be mounted over the top platform of a step ladder.

Stepladders are quite useful when a worker needs to reach a location above the ground or floor level for performing construction and maintenance chores, both on a work site and in the home. It is often desirable while the worker is on the stepladder for the worker to have access to tools, parts and work supplies that are needed during the performance his duties or chores.

Many devices have been invented over the years that attach to a stepladder to hold the tools, parts and work supplies so that they are easily accessible to the worker while he is standing on or otherwise using the stepladder.

Many of these devices attach directly by articulated arms or fingers to one or more of the rungs of the stepladder. The devices which attach to the rungs of a stepladder usually require the worker to be careful when ascending or descending the stepladder to avoid knocking the device off the rungs of the ladder. These devices also generally require some type of clamp or connection device to secure the arms to the rungs of the stepladder. Typical of these types of devices is the ladder caddy shown in U.S. Pat. No. 4,480,810 to Hall.

These types of connection devices can be quite complicated because stepladders come in two basic varieties: steps that have rounded rungs and steps that have flat rungs. The devices must be designed to work on either round or flat rungs, otherwise the market for the device is limited.

Devices have also been invented that attach to the flat top platform of a step ladder. Typical of these prior art devices is the basket shown in U.S. Pat. No. 2,911,133 to Ruggieri and the paint can holder shown in U.S. Pat. No. 3,285,557 to Reda. Each of these devices use a clamping member that hooks or loops over the top platform of the stepladder. Each of these devices uses the folding platform that is provided on many stepladders as the bottom weight support for any tools, equipment or work supplies that are placed in the device.

The Hall patent, U.S. Pat. No. 4,480,810, also discloses an alternate version of his device that attaches to the top platform of a stepladder. The supplies compartment of the Hall device rests against the back legs of the stepladder and a clamp member hooks over the top platform of the stepladder and is secured thereto by means of a retaining lip that loops underneath the top platform. The position of the retaining lip is adjustable by means of a wing nut fastener that allows the effective length of the retaining lip to be changed to fit various sizes of stepladders.

It is an object of the present invention to provide an accessory container suitable for use with a stepladder which attaches to the stepladder over the top platform of the stepladder and which provides strength and stability regardless of the weight of the work supplies that are placed in the container.

It is a further object of the present invention to provide an accessory container that is easy to install over the top platform of a stepladder and that is capable of holding large quantities of tools, equipment and work supplies.

It is a feature of the present invention that the accessory container includes a forward compartment defined by a front wall, a back interior wall, a bottom wall and right and left side walls but with an open top so that tools, equipment and work supplies can be placed in the forward compartment. The accessory container also has a rearward compartment having an open bottom and defined by a top plate, the back interior wall and side wall extensions of the right and left side walls so that the rearward compartment can encompass the top platform of a stepladder. The rearward compartment is preferably formed integrally with the forward compartment. The back interior wall of the accessory container rests against the back legs of the stepladder to give the accessory container structural strength and stability.

It is a further feature of the present invention that the rearward compartment includes a rear overlapping lip that hooks over the top platform of the stepladder. When weight is placed in the forward compartment, the weight is transferred into the rear legs of the stepladder and into the top corner of the stepladder top platform. This weight transfer causes the accessory container to securely grip the stepladder and holds the accessory container firmly in place on top of the stepladder.

It is an advantage of the present invention that the accessory container easily adapts to most stepladders without the necessity of using clamping or connection devices. The accessory container is mounted to encompass the top platform of the stepladder and the weight of the items placed in the forward compartment of the accessory container urges the container against the back legs of the stepladder and against the top corner of the stepladder top platform to hold the accessory container in place during use.

SUMMARY OF THE INVENTION

An accessory container is designed to be mounted over the top platform of a stepladder. The accessory container includes a forward compartment defined by a front wall, a back interior wall, a right side wall, a left side wall and a bottom wall. The forward compartment is open at the top and provides a storage area for holding tools, equipment and other work supplies that are needed by the worker when he is using the stepladder to perform construction or maintenance chores.

The accessory container further includes a rearward compartment defined by the back interior wall, side wall extensions on each of the right and left side walls, a top plate and a rear overlapping lip. The rearward compartment is open at the bottom and allows the accessory container to be mounted over the top of the stepladder. The top platform of the stepladder abuts the underside of the top plate of the accessory container and the rear legs of the stepladder abut the back interior wall of the accessory container. The top corner of the stepladder's top platform hooks under the rear overlapping lip of the rear compartment of the accessory container. This arrangement results in any weight that is placed in the forward compartment being transferred through the back interior wall of the accessory container to the rear legs of the stepladder. This increases the structural stability of the accessory container and holds it securely in place on the stepladder. The stepladder can be moved from place to place in an open locked position without having to first remove the accessory container.

DETAILED DESCRIPTION OF THE PREFERRED EMBODIMENTS

Figure 1:
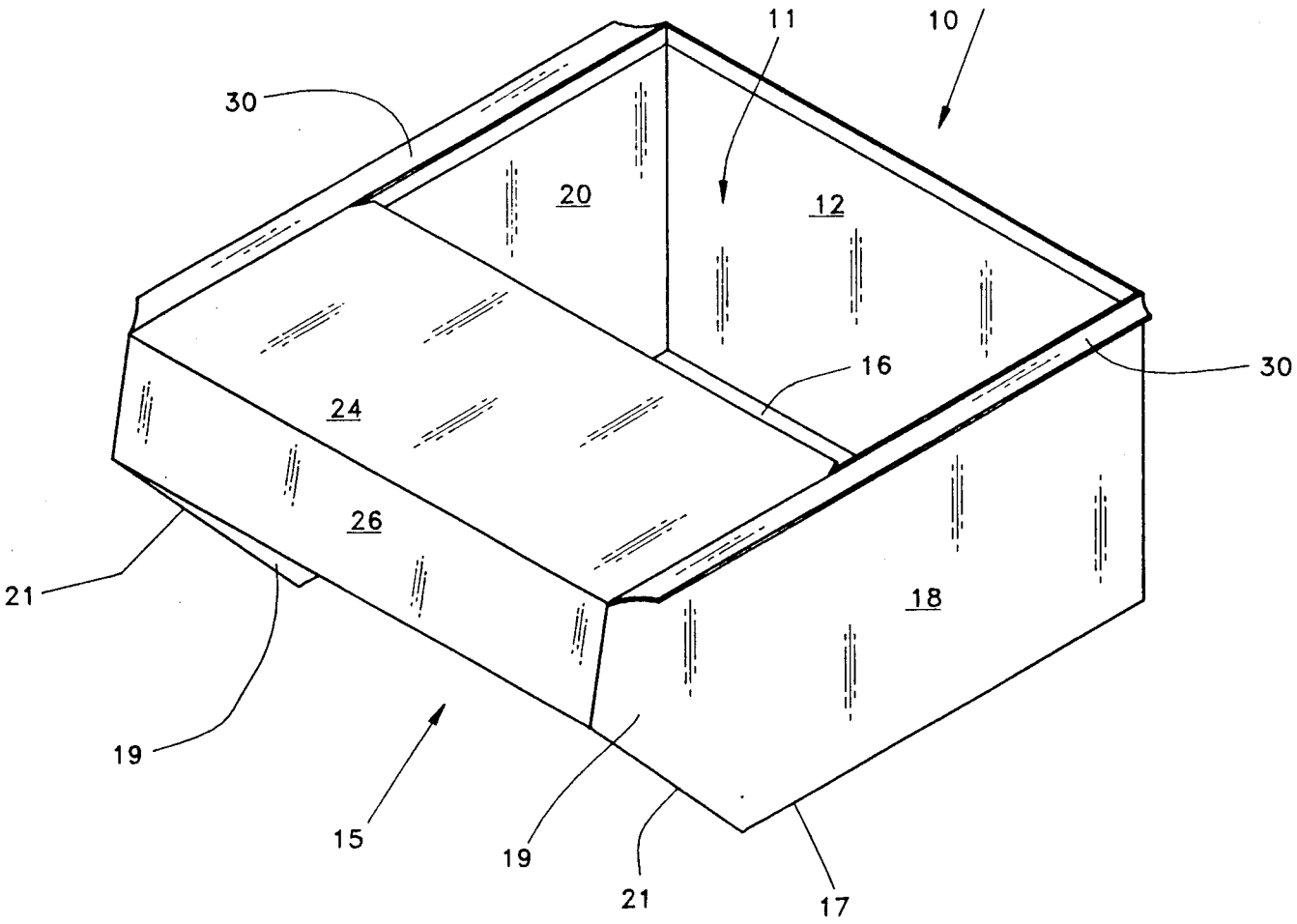
FIG. 1 shows a perspective view of the accessory container of the present invention.
Figure 2:
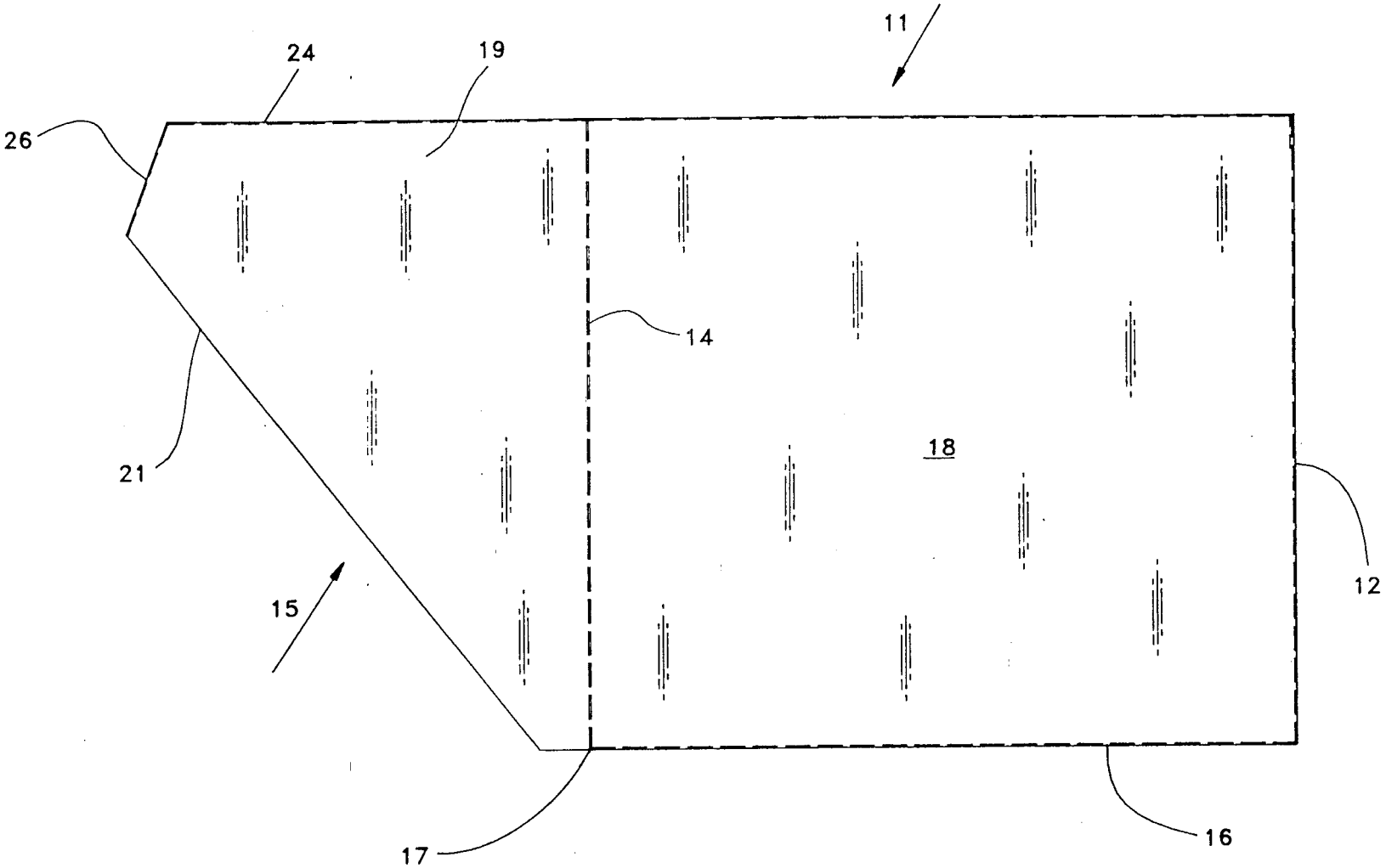
FIG. 2 shows a side view of the accessory container of the present invention.

The accessory container of the present invention is shown generally at 10 in the drawings. Referring to FIG. 1 and FIG. 2, the accessory container 10 includes a forward compartment 11 which is formed by the front wall 12, the back interior wall 14, the bottom wall 16, the left side wall 18 and the right side wall 20. The forward compartment 11 is open at its top which allows tools, equipment and work supplies to be placed into the forward compartment 11 for easy access by the worker when the accessory container 10 is mounted onto the top of a stepladder 40 (see FIG. 3). The top edges of the accessory container may be provided with hand grips 30 to ease the movement of the accessory container onto and off of a stepladder.

The accessory container 10 is provided with a rearward compartment 15 in adjoining relationship to the forward compartment 11. In the preferred embodiment of the present invention, the rearward compartment 15 is formed integrally with the forward compartment 11. The rearward compartment 15 is defined by the back interior wall 14, the side wall extension 19 on the right side wall 20 and a corresponding side wall extension 19 on the left side wall 18, a top plate 24 and a rear overlapping lip 26. The rearward compartment 15 is open at its bottom which allows the rearward compartment 15 to be placed over the top of a stepladder.

Figure 3:
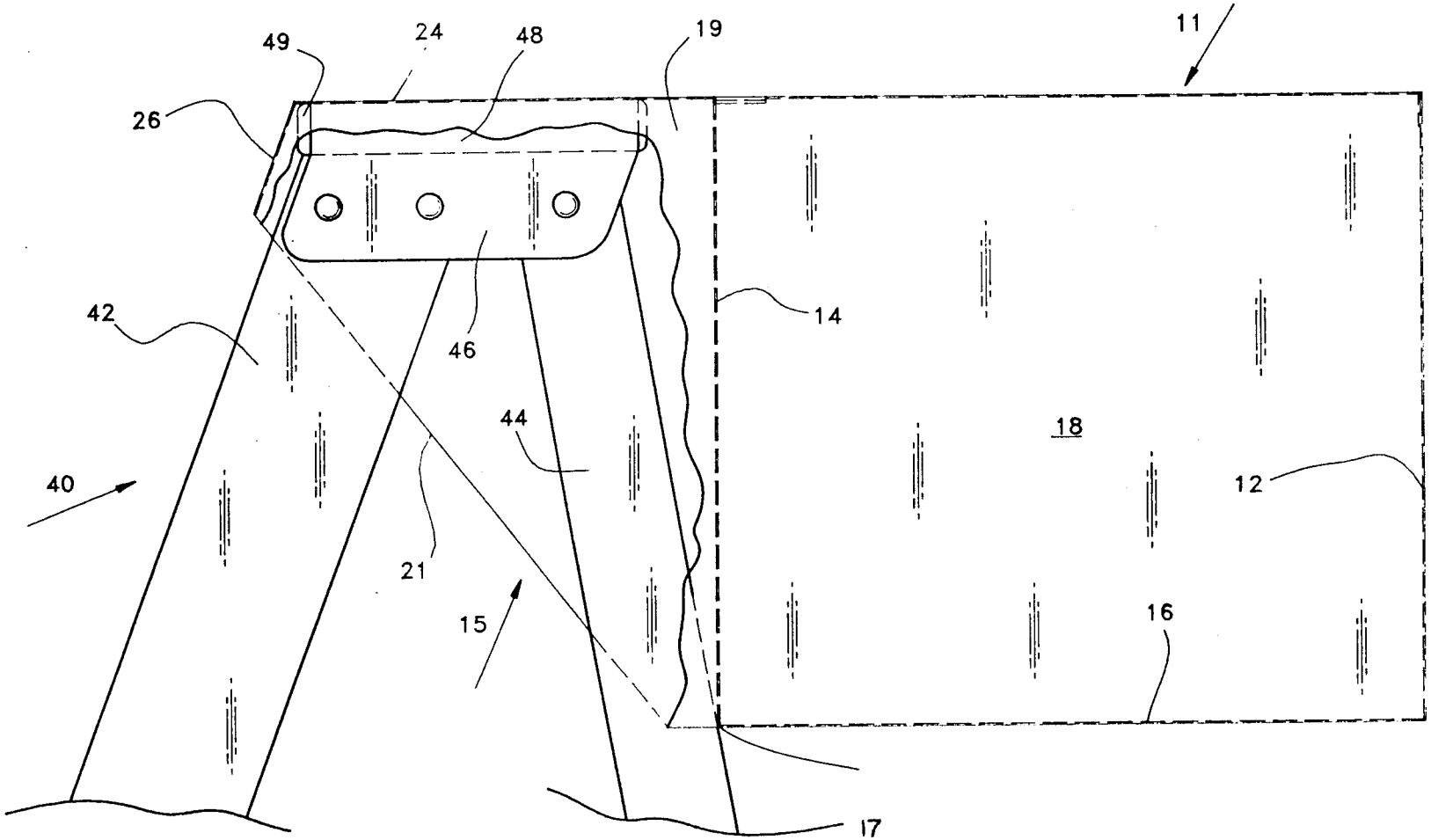
FIG. 3 shows a side view of the accessory container of the present invention mounted over the top platform of a stepladder.

As shown in FIG. 3, a typical stepladder 40 comprises a pair of front ladder legs 42, a pair of back ladder legs 44, a ladder leg connector 46 connecting each front ladder leg 42 to the respective back ladder leg 44 and a ladder top platform 48.

When the accessory container 10 is located on the stepladder 40, the rearward compartment 15 surrounds the entire top of the stepladder 40. The underside of the top plate 24 of the accessory container 10 abuts the top of the ladder top platform 48. In the preferred embodiment, the width of the top plate 24 is selected so that most stepladders will fit into the rearward compartment 15 regardless of the width of the ladder top platform 48. The top corner 49 of the top platform 48 abuts into the angle formed by the top plate 24 and the rear overlapping lip 26 of the rear compartment 15.

The back interior wall 14 of the accessory container 10 abuts against each of the back ladder legs 44 at leg contact point 17. Any weight that is placed into the forward compartment 11 in the form of tools, equipment or work supplies is transferred by the back interior wall 14 into the back ladder leg 44 of the stepladder 40 at this contact point 17. This transfer of weight stabilizes the accessory container 10 and prevents the accessory container 10 from inadvertently falling off the stepladder 40. This design also allows to the accessory container 10 to achieve a relatively level orientation when it is mounted on most stepladders.

The rear overlapping lip 26 extends down and below the top plate 24 of the accessory container 10. When weight is placed into the forward compartment 14, this weight is transferred not only into the back legs 44 of the stepladder, but also into the rear overlapping lip 26. The rear overlapping lip 26 hooks around the top corner 49 of the top platform 48 of the stepladder 40. This holds the accessory container 10 securely to the top of the stepladder 40 and the more weight that is placed into the forward compartment 11, the more securely the accessory container 10 is held to the stepladder 40. This arrangement also prevents the accessory container 10 from slipping off the top platform 48 of the stepladder 40 when the stepladder 40 is being moved from one work location to another work location.

The lower end of the rear overlapping lip 26 is joined to the bottom 16 of the forward compartment 11 along angled edge 21. This arrangement minimizes the possibility that a worker climbing the stepladder could catch one of his feet on the accessory container and fall off the stepladder or knock the accessory container off the stepladder.

The side wall extension 19 on each of the left side wall 18 and the right side wall 20 surround the lateral sides of the stepladder 40. These wall extensions 19 prevent the accessory container 10 from slipping off the top platform 48 of the stepladder 40 when the stepladder 40 is being moved from one work location to another work location.

Various materials can be used in the manufacture of the accessory container and the preferred materials are metal or plastic. The design of the accessory container adapts quite easily to a plastic injection molding manufacture.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. An accessory container for use with a stepladder having front legs, back legs and a top platform comprising:

a) a forward compartment including a front wall, a back interior wall, a bottom wall, a left side wall and a right side wall, b) a rearward compartment formed integrally with the forward compartment and including the back interior wall, a side wall extension attached to the left side wall, a side wall extension attached to the right side wall, a top plate and a rear overlapping lip whereby when the accessory container is mounted to the top platform of the stepladder, the sidewall extensions surround the front and back legs of the stepladder and the weight from the forward compartment is transferred through the back interior wall into the legs of the stepladder and through the rear overlapping lip into the top platform of the stepladder.

2. The accessory container of claim 1 wherein the rearward compartment surrounds the entire top platform of the stepladder.

3. The accessory container of claim 1 wherein the rear overlapping lip attaches to the top plate at an angle so that the rear overlapping lip hooks into a top corner of the top platform of the stepladder when weight is placed into the front compartment of the accessory container.

4. The accessory container of claim 1 further including at least one hand grip attached to the forward compartment.

* * * * *